United States Patent [19]

Tourand

[11] 4,305,580

[45] Dec. 15, 1981

[54] LIQUID-PROPELLED SCORING GAME

[76] Inventor: Thomas C. Tourand, 2662 Butner Rd., Atlanta, Ga. 30331

[21] Appl. No.: 77,563

[22] Filed: Sep. 21, 1979

[51] Int. Cl.[3] ..... A63F 7/00

[52] U.S. Cl. ..... 273/1 L; 273/85 H

[58] Field of Search ..... 273/1 L, 85 H, 119 B, 273/349, 350, DIG. 26, 126 A; 272/1 B

[56] References Cited

U.S. PATENT DOCUMENTS

| | | | |
|---|---|---|---|
| 2,869,874 | 1/1959 | Berdner | 273/119 B |
| 3,362,713 | 1/1968 | Miller | 273/119 B X |
| 3,773,325 | 11/1973 | Crossman et al. | 273/126 A |
| 4,136,872 | 1/1979 | Matsumoto | 273/85 H |
| 4,173,338 | 11/1979 | Barnett | 273/DIG. 26 X |

FOREIGN PATENT DOCUMENTS

| | | | |
|---|---|---|---|
| 548979 | 10/1956 | Italy | 273/85 H |

*Primary Examiner*—Paul E. Shapiro

*Attorney, Agent, or Firm*—Newton, Hopkins & Ormsby

[57] ABSTRACT

A game comprising a housing with a liquid-filled playing area therein having defined passageways which are dimensioned to receive a projectile. A first player operates a first liquid directing plunger which creates currents within the liquid-filled playing area that propel the projectile toward a first target while a second player simultaneously manipulates a second liquid directing plunger in an attempt to cause the projectile to deviate away from the path of travel through the liquid toward the first target and towards a second target associated with the second player. A liquid reservoir, pump and conduits are provided for filling the playing area with liquid before the start of play and for evacuating the liquid from the playing area after a predetermined amount of playing time has elapsed. A coin controlled timer controls operation of the pump and plungers to limit the periods of play.

17 Claims, 3 Drawing Figures

LIQUID-PROPELLED SCORING GAME

BACKGROUND OF THE INVENTION

1. Field of the Invention

This invention relates to an amusement device and, more particularly, to a water-propelled scoring game.

2. Description of the Prior Art

Several devices have been proposed wherein a player manipulates a projectile by means of air pressure towards a target area while his opponent attempts by means of his supply of pressurized air to deflect the projectile away from that target area and towards his own target or goal. In those games, the players may propel a number of projectiles towards different goals. None of the prior art games provides a satisfactory amusement device wherein the players manipulate a projectile within a playing area that is full of water.

SUMMARY OF THE INVENTION

The above disadvantage is overcome by the present invention which includes a water-propelled scoring game that may be played by two or more opponents. The game is coin-actuated with a predetermined amount of playing time made available and includes a housing wherein a water-tight playing area is defined, the interior of which being visible to the players. Two coplanar projectile channels are disposed within the playing area in substantially 45° opposed attitudes, the longitudinal axes of the channels intersecting at a point which is distant from the channels but which is within the playing area.

The players operate water directing means associated with each channel to propel a projectile out of a respective channel toward a target means located exteriorly of the channel but adjacent the longitudinal axis of that channel. While one player is manipulating his water directing means to send the projectile on a desired path of travel, his opponent is attempting, through the opponent's own water directing means, to deflect the projectile from that desired path of travel. Scoring means are connected to the target means to register for that player the fact that he was successful in having the projectile pass the target means.

A water storage tank is within the housing, and pump means associated therewith transmit the water into the playing area at the start of the game. Means is associated with the playing area to evacuate the water therefrom back into the storage tank at the end of the playing time. The water storage tank is also provided with automatic means to replenish the water volume therein from a remote source.

The water directing means includes a nozzle disposed within each channel and which is in fluid communication with a manually operable plunger on the exterior of the housing. Pressing downward on the plungers causes water to be discharged under pressure from the respective nozzle into the respective channel whereby currents are created within the water contained in the playing area that effect the direction of travel of the projectile.

A first means for detecting when a projectile has been deflected by an opponent away from the desired target area is electrically connected to the nozzles to prohibit further water from being expelled from the nozzles until the projectile once again is situated within a channel. When that occurs, a second detecting means in each of the channels is energized to allow play to resume. The first and second detecting means prevent the players from continuously operating their respective plungers so that unnecessary currents are not created in the water within the playing area which would severely limit the amount of play available to the players during the allotted time.

It is, therefore, the primary object of the present invention to provide a water-propelled scoring game.

Another object of the present invention is to provide a game wherein the players activate jets of water to affect the paths of travel of a projectile within a water-filled playing area.

A still further object of the present invention is to provide a game wherein players competitively manipulate a projectile within a water-filled playing area toward respective target areas.

A further object of the present invention is to provide a game which is easy to play and provide a challenge to the players.

DESCRIPTION OF THE ILLUSTRATIVE EMBODIMENT

Figure 1:
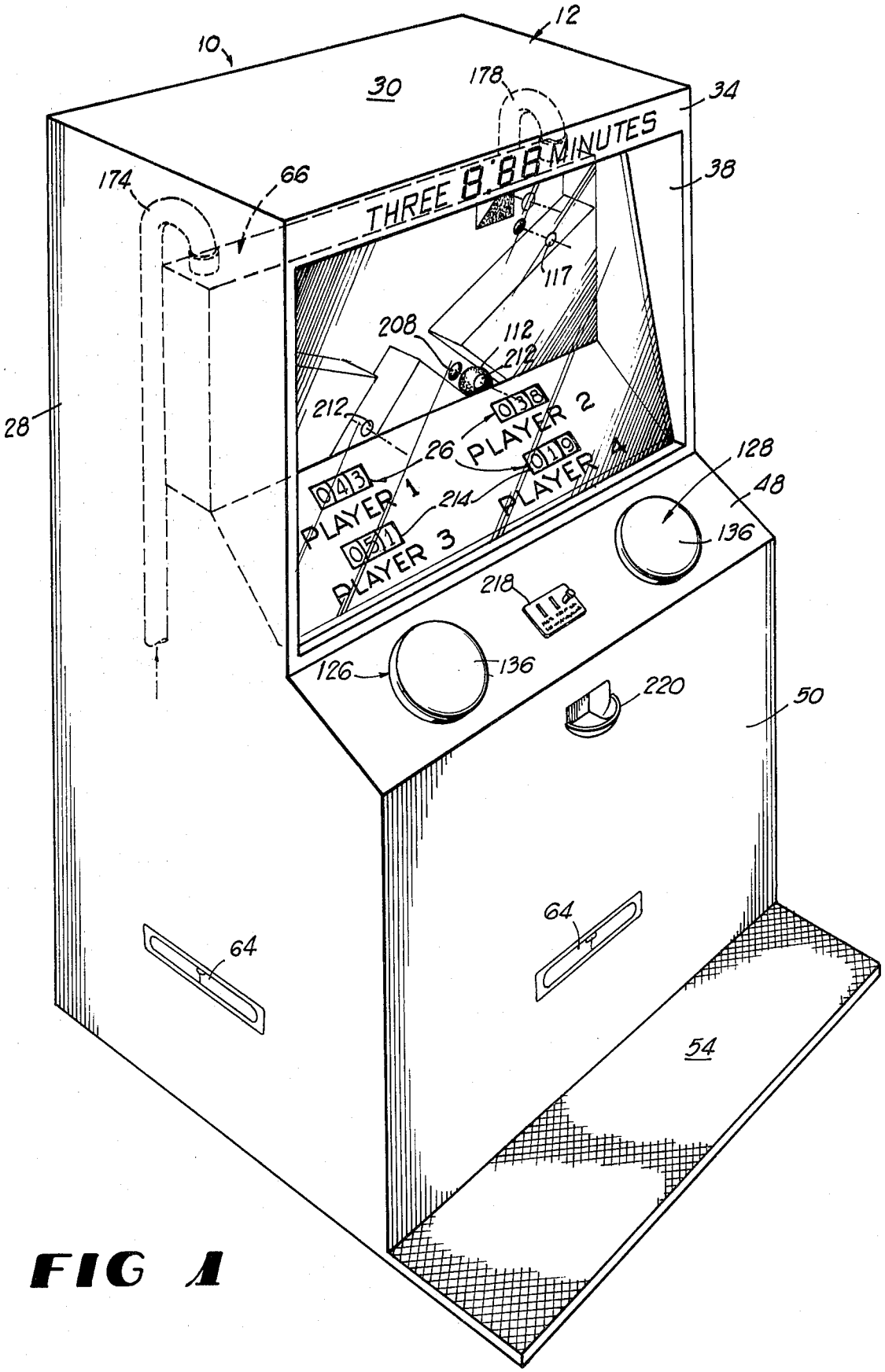
FIG. 1 is a perspective view of the present invention with some elements shown in phantom lines.
Figure 3:
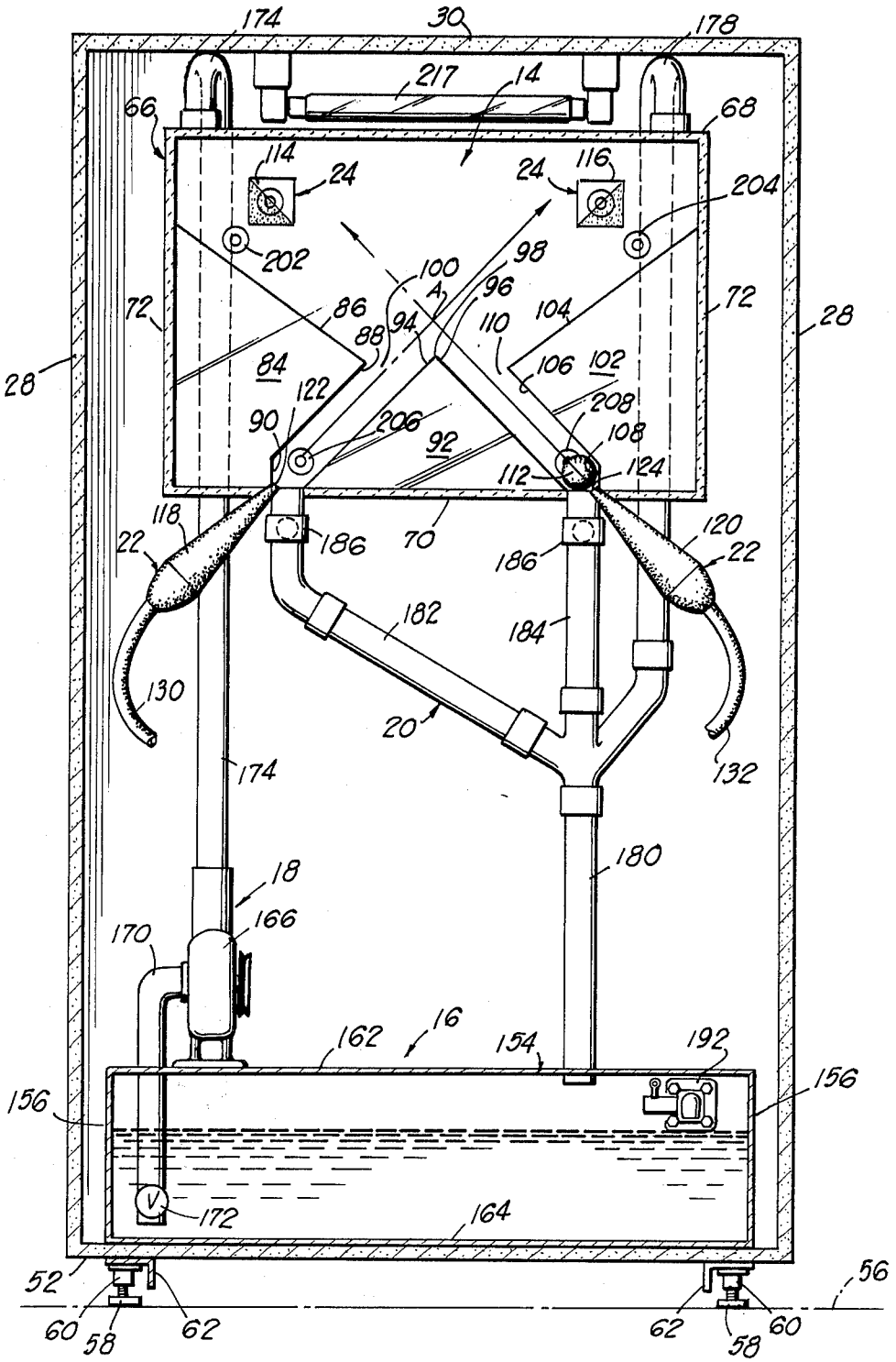
FIG. 3 is a view taken along lines 3—3 in FIG. 2.

Referring to FIGS. 1 and 3 of the drawings, the numeral 10 denotes generally the present invention which includes a housing 12, a playing area 14, a water supply 16, a water pumping means 18, a water evacuating means 20, water directing means 22, target means 24 and score displaying area 26.

The housing 12 is constructed of suitable material, preferably metal, and includes parallel, upstanding side walls 28 joined at their upper ends by horizontal top 30 and along their rear ends by rear wall 32. The front of housing 12 includes a rectangular shaped, vertical upper panel 34 in which is disposed a small rectangular-shaped opening 36 adjacent the horizontal top 30.

A large, rectangular opening 38 is formed within the upper panel 34 below opening 36. A downwardly slanted overhang portion 40 extends from the top of opening 38 into the interior of the housing 12 and vertical sides 42 extend inwardly from the side edges of opening 38. Bottom element 44 extends upwardly from the bottom edge of opening 38 into the interior of housing 12. The rear edges of overhang portion 40, sides 42 and element 44 terminate in a common vertical plane. Sloping downwardly from overhang portion 40 to bottom element 44 is a clear pane 46 of glass or plastic.

A middle panel 48 is inclined downwardly and outwardly from the bottom edge of upper panel 34 and terminates in vertical bottom panel 50. The housing 12 further includes a horizontal bottom 52 which extends beyond the lower edge of bottom panel 50 to form a platform upon which is secured a rubber mat 54.

Figure 2:
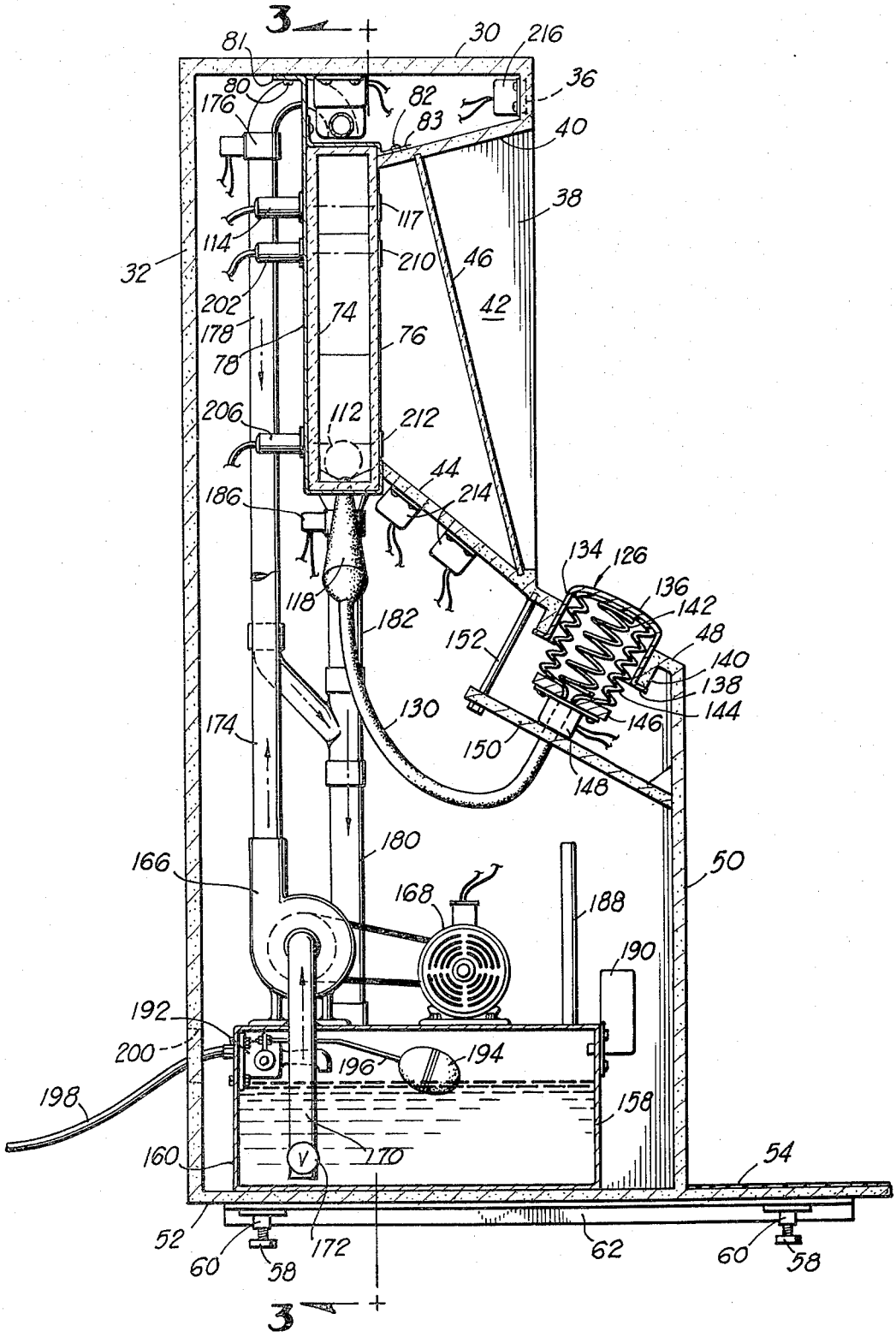
FIG. 2 is a cross-sectional, side elevational view of the present invention.

As seen in FIGS. 2 and 3, the housing 12 is supported above the floor 56 by means of two pairs of spaced, height-adjustable elements formed of threaded screws 58 which are received within complimentarily-threaded housings 60. The housings 60 are secured to the underside of L-shaped channel members 62 which longitudinally extend along bottom 52. Independent adjustment of the screws 58 will affect the horizontal level of the housing 12 as measured by the leveling bubble indicators 64 which are incorporated in side walls 28 and bottom panel 50, as shown in FIG. 1.

Referring to FIG. 3, the playing area 14 is defined by a water-tight rectangular vessel 66 formed from top 68, bottom 70, side walls 72 and rear wall 74. The front wall 76 of the vessel 66 is of clear glass or plastic and is in abutting engagement with the rear edges of overhang portion 40, sides 42 and bottom element 44. The vessel 66 is maintained in its proper orientation within housing 12 by means of a metal frame 78 which extends about the exterior of vessel 66 and which is attached to the underside of top 30 by bolt 80 through flange 81 and to the top of overhang portion 40 by bolt 82 through flange 83. The length and width of front wall 76 is substantially equal to the opening formed by the rear edges of overhang portion 40, sides 42 and element 44.

As seen more clearly in FIG. 3, the interior of vessel 66 includes a solid, transversely extending articulated bottom portion formed of three sections. The first section 84 has a downwardly sloping top surface 86 which starts approximately two-thirds up along side 72 and sharply terminates with an inwardly and downwardly directed surface 88 which ends in a vertical surface 90.

The middle section 92 is substantially in the shape of an isosceles triangle, having equal sides 94, 96 which meet at point 98. Side 94 is parallel to surface 88. Side 94, and surfaces 88, 90 and 94 define a channel 100.

The third section 102 is essentially the mirror image of the first section 84 and includes like surfaces 104, 106 and 108, with side 96 surfaces 106, 108 defining a channel 110. The longitudinal axes of channels 100, 110 intersect at essentially 90° angles above point 98 at position A within the interior of vessel 66. Channels 100, 110 are dimensioned so as to freely receive therein a round projectile 112 having a solid exterior surface.

As seen in FIGS. 2 and 3, the target means 24 includes two photoelectric cells 114, 116 which extend through the rear wall 74 and are positioned above the first and second sections 84, 102, adjacent the longitudinal axes of channels 110, 100, respectively. A pair of beam reflectors 117, shown in FIG. 2, are disposed on front wall 76 in opposed relationship to a respective target cells 114, 116.

The water directing means 22 include nozzles 118, 120 which have venturi exhaust openings 122, 124 which project through bottom wall 70 into channels 100, 110, respectively. As shown in FIG. 2, the nozzles 118, 120 are connected to plungers 126, 128 through water tubes 130, 132 respectively. The plungers 126, 128 include an annular metal cover formed of a cylindrical side wall 134 with integral top 136 and lower flange 138. The plungers 126, 128 extend through spaced openings in middle panel 48 which are defined by annular shells 140, the upper surface of the flanges 138 normally biased against the lower surface of shells 140 by means of coiled springs 142 which are contained within water-sealed rubber bellows 144. The bottom of each bellows 144 is attached to bearing plate 146 which is secured to plunger solenoid valve 148 that rests on shelf 150. The shelf 150 juts into the interior of housing 12 from the surface of lower panel 50 substantially parallel to middle panel 48, as seen in FIG. 2, and is secured to the underside of bottom element 44 by a plurality of spaced, elongated bolts 152. The interior of each bellows 144 is in fluid communication with a respective one of the nozzles 118 or 120 by means of water tubes 130, 132 which have one of their ends pass through shelf 150.

Referring to FIGS. 2 and 3, the water supply 16 includes a rectangularly shaped, sealed reservoir 154 having sides 156, front and back walls 158, 160, top 162 and bottom 164 which rests on the bottom 52 of housing 12. Water pumping means 18 includes a centrifugal water pump 166 which is powered by an electric motor 168, both of which are secured on top 162. A pick-up conduit 170, having a check-valve 172 therein adjacent its bottom end, extends from pump 166 into the interior of the reservoir 154 through top 162.

An elongated fill tube 174 is in communication by one of its ends with the exhaust opening of pump 166 and with the interior of vessel 66 at its other end, through top 68, as shown more clearly in FIG. 3. A diaphragm sensor 176 is disposed within fill tube 174 adjacent top 68, as seen in FIG. 2, and is electrically connected to pump 166, as explained in detail hereinbelow.

The water evacuating means 20 includes vessel overflow conduit 178 which extends through top 68 of vessel 66 and joins, at its bottom end, with reservoir return tube 180 which is disposed through top 162 and extends into the interior reservoir 154, as shown in FIG. 3. The water evacuating means 30 further comprises drain conduits 182, 184 which are in communication with the bottoms of channels 100, 110, respectively. The lower ends of drain conduits 182, 184 are in communication with reservoir return tube 180. Valves 186 are disposed within drain conduits 182, 184 adjacent bottom 70 and are electrically connected to the timing mechanism of game 10, as will be described hereinafter.

The reservoir 154 further includes a vent tube 188 disposed through top 162 and chemical dispenser 190 which is attached to the exterior of front wall 158 and which is in communication with the interior of reservoir 154, as seen in FIG. 2, in order to periodically eject purifying chemicals into the water.

Means is provided for supply of fresh water into reservoir 154 and includes float valve 192 secured to the inner surface of rear wall 160 adjacent top 162. A float 194 is connected to valve 192 by means of arm 196. Hose 198, which extends through opening 200 in rear wall 32, joins the float valve 192 with a remote source of water.

Electric eyes 202, 204 extend into the interior of vessel 66 through rear wall 74 below cells 114, 116 and above sloping top surfaces 86, 104, respectively. Another pair of photoelectric cells 206, 208 are disposed through rear wall 74 along the longitudinal axes of channels 100, 110, respectively, adjacent the bottoms thereof. Reflectors 210, 212 are positioned on the surface of front wall 76 in co-axial alignment with eyes 202, 204 & 206, 208, respectively. The eyes 202, 204 and cells 206, 208 are electrically connected to the plunger solenoid valves 148 associated with each bellows 144. When the projectile 112 passes between either of eyes 202, 204 and the associated beam reflector 210, then the plunger solenoid valves 148 are closed to prevent water from exiting nozzles 118, 120 until the projectile 112 rests at the bottom of either channel 100 or 110, thereby breaking the beam between either 206 or 208, and an associated reflector 212, respectively. Actuation of either cell 206 or 208 causes the plunger solenoid valves 148 to open, thereby allowing play to resume. The above described disruption of play to allow the projectile 112 to assume its rest position within a channel 100, 110 is so that the players will not create such an undue amount of currents within the water by operation of their respective plungers 126, 128 that play cannot take place.

The score displaying area 26 includes four counters 214 which are electrically connected to target cells 114, 116 to visually indicate a score for a player who has the projectile 112 sensed by a respective target cell 114 or 116. Disposed within opening 36 is a timing indicator 216 which visually represents the time remaining to be played in the game. An electric light 217 is disposed within the interior of housing 12 above vessel 66.

Coin receiving slots 218 are provided in the middle of panel 48 and are electrically connected to the pump motor 168 to actuate the filling of vessel 66 upon start of the game and to actuate the opening of plunger solenoid valves 148 to allow operation of plungers 126, 128. A coin return 220 is disposed in panel 50 beneath the coin receiving slots 218.

The check valve 172 substantially reduces the amount of air that will be entrained within the water directing means 22. That is because the water is prevented from leaving the tube 170 and returning to reservoir 154 when the pump 166 stops its operation, thereby preventing bubbles of air from forming in the water.

With regard to the pump 166, it is understood that the type of pump which was capable of being submerged within the water contained in reservoir 154 could also be used. It is further understood that all electrical connections associated with the elements comprising the present invention are sealed against water invasion. Of course, other liquids may be used in place of water, provided view of the projectile is still possible.

OPERATION

The present invention can be played with 2, 3 or 4 players. The threaded screws 58 are adjustable so that the bubble indicators 64 indicate that the housing 12 is at the proper orientation with respect to the floor 56, namely, that bottom 52 is parallel to floor 56. Once the level of housing 12 is adjusted, the players may initiate play by inserting the requisite amount of coinage into slots 218, thereby actuating pump motor 168 which drives pump 166.

Water is removed from the interior of reservoir 154 through pick-up conduit 170. The water continues to be pumped upward through fill tube 174 which empties into vessel 66. Meanwhile, the nozzles 118, 120 and water tubes 130, 132 and the interior of bellows 144 are filled with water by pressing down on plungers 126, 128 to purge the bellows 144 of air while vessel 66 is filling. When the level of water within vessel 66 causes the water to back-up into fill tube 174, that condition is sensed by diaphragm sensor 176 which is actuated to turn off pump 166, stopping the flow of water into vessel 66. The valves 186 within drain conduits 182, 184 are, of course, in their closed positions, preventing water from exiting the playing area 14 which is now completely submerged.

The light 217 is now on to illuminate the playing area 14. The timing indicator 216 reflects that, for instance, three minutes of play is available to the players. The indicator 216 begins to count-down the time when the pump motor 168 is automatically shut off. The counters 214 are each at the zero mark.

The players stand upon rubber mat 54 and begin play by pressing downward upon the plunger 126 of 128 associated with the channel 100 or 110 in which projectile 112 rests. As seen in FIGS. 1 and 3, the projectile 112 is shown in its rest position within channel 110 so that the first player presses downward on plunger 128. Initially, it may be necessary to repeatedly manipulate the plungers 126 or 128 so as to expel any residual air trapped within water tubes 130, 132 and nozzles 118, 120.

After the water directing means 22 has been sufficiently purged of air, continued downward pressing on plunger 128 expels a stream of water out of exhaust opening 124 which engages the projectile 112, propelling it along channel 110 toward the target 114. The opposing player, operating plunger 126, waits until the projectile 112 nears position A within the playing area 14 so that the water expelled from his nozzle 118 will be in alignment with projectile 112. The opposer attempts, by manipulation of his plunger 126, to cause the projectile 112 to deviate from its path of travel toward target cell 114 and, instead, to move toward the opposer's target cell 116. If, before the projectile 112 is able to pass in front of target cell 114 or 116, the projectile 112 breaks the beam generated by electric eyes 202 or 204, the solenoid valves 148 will be actuated to stop the flow of water through the water tubes 130, 132, even though the plunger 126, 128 may continue to be pressed downwardly by the opposing players. Since the nozzles 118, 120 are now unable to expel any water, the projectile will begin to float downwardly within the water until it engages and rolls down either top surface 86 or 104 and thence down either channel 100 or 110 until it again assumes its rest position. It can thus be seen that the construction of the sections 84, 92 and 102 is such that the projectile 112 will automatically and quickly enter either channel 100 or 110 when water pressure ceases to be applied to the projectile 112. When it reaches its rest position, the projectile will pass through the beam generated by either cell 206 or 208, thereby actuating valves 148 to their open position, allowing play to resume. When, during continued play, the projectile 112 passes a target cell 114 or 116, the respective beam will be broken and a score will be generated on a respective counter 214.

During operation of the game 10, the players will be able to view generally the currents created in the water within the playing area 14 by operation of the plungers 126, 128 in attempting to propel the projectile 112 towards a target cell 114 or 116. The players' ability to see the currents in the water will enable them to more accurately plan game strategy. To enhance the players' view of the currents in the water, a chemical or colored water may be injected into the water either through any point along the water directing means 22, such as water tubes 130, 132, or at the base of the channels 100, 112.

After the pre-selected amount of playing time has expired, the valves 148 will again close and valves 186 in drain conduits 182, 184 will open, allowing the water within vessel 66 to return, via tube 180, into reservoir 154. Simultaneous with the opening of valves 186, the solenoid valves 148 will also close, thereby preventing water from exiting the nozzles 118, 120 even though the plungers 126, 128 are continued to be pressed downwardly.

During continued operation of the game 10, the water level within reservoir 154 may drop due to evaporation. The float 194 will sense that loss of water and will actuate valve 192 to allow water from a remote source to enter the reservoir 154 until the float valve 194 returns to its preselected position.

What I claim is:

1. A game including a housing, a playing area defined within said housing which is capable of retaining a volume of water therein, a projectile disposed within said playing area, a target means within said playing area, and independently operable means for directing water at said projectile so as to propel said projectile to said target means, wherein the improvement comprises:

a reservoir of water within said housing in communication with said playing area, said reservoir capable of retaining at least said volume of water, means for transferring said volume of water from said reservoir into said playing area, means for evacuating said volume of water from said playing area into said reservoir, means on said housing for activation of said game, timing means operable for a selected period of time and being electrically connected to said game activation means whereby said timing means is energized by said game activation means, said timing means then actuating said transferring means to cause said volume of water to flow into said playing area from said reservoir and be held within said playing area substantially filling said playing area and, after passage of said selected period, to cause said evacuating means to allow said water to flow out of said playing area into said reservoir, and water directing means including a pair of nozzles having exhaust openings which are disposed within said playing area, plunger means on said housing, means for communicating the interior of said plunger means with said nozzles, whereby manipulation of said plunger means causes a stream of water under pressure to exit said exhaust openings and to propel said projectile in a desired direction within said playing area, and means for activating and deactivating said plunger means, said activating and deactivating means being actuated to activate said plunger means by said timing means after energization of said timing means, and after passage of said selected period, being deactuated by said timing means to deactivate said plunger means.

2. A game as claimed in claim 1 further including scoring means connected to said target means whereby said scoring means visually indicates when said projectile reaches said target means.

3. A game as claimed in claim 1 wherein said transferring means includes a pump in communication with said reservoir of water, a motor to drive said pump and a fluid conduit interconnecting said pump and said playing area.

4. A game as claimed in claim 3 wherein said evacuating means includes a fluid tube in flow communication with said playing area and said reservoir of water and valve means on said fluid tube which is operable between a closed position to prevent water from returning to said reservoir and an open position to allow water to flow to said reservoir.

5. A game as claimed in claim 4 wherein said game activation means includes coin receiving means on said housing, and said timing means operable for a selected period is electrically connected to said valve means whereby upon energization by said coin receiving means said timing means causes said valve to move to said closed position to allow said volume of water to be held within said playing area and actuates said motor to drive said pump to cause said volume of water to flow into said playing area and, after passage of said selected period, causes said valve to move to said open position to allow said water to flow out of said playing area through said fluid tube into said reservoir.

6. A game as claimed in claim 1 further including means associated with said playing area for detecting the position of said projectile within said playing area and for temporarily deactivating said independently operable directing means during play upon detection of said projectile.

7. A liquid-propelled scoring game, which utilizes a volume of liquid, including a housing, a playing area defined within said housing and which is capable of holding a volume of liquid therein, a pair of projectile channels within said playing area and having longitudinal axes which intersect within said playing area, a projectile dimensioned to be received within said channels and independently operable liquid directing means in communication with said channels, wherein the improvement comprises:

a first means in said playing area associated with said channels for detecting the position of said projectile remote from said channels, scoring means electrically connected to said first detecting means so that when a volume of liquid is held within said playing area, the actuation of a selected one of said liquid directing means to propel said projectile within an associated one of said channels through said detecting means associated with said one channel will register on said scoring means, means for activating and deactivating said directing means, timing means operable for a selected period of time connected to said activating and deactivating means, means on said housing for activation of said game electrically connected to said timing means, said game activation means serving to energize said timing means, said timing means after energization serving to actuate said activating and deactivating means to activate said directing means, and after passage of said selected period of time serving to deactivate said directing means by deactuating said activating and deactivating means, and second means associated with said playing area and said projectile channels for detecting the position of said projectile within said playing area and to cause said activating and deactivating means to deactuate said directing means during play upon detection of said projectile within said playing area and to cause said activating and deactivating means to activate said directing means upon detection of said projectile within said channels.

8. A liquid-propelled scoring game as claimed in claim 7 wherein said channels are in an upright attitude and said longitudinal axes are co-planar to a vertical cross-section of said playing area.

9. A liquid-propelled scoring game as claimed in claim 7 further including a supply of liquid and a reservoir within said housing for containing said supply of liquid.

10. A liquid-propelled scoring game as claimed in claim 9 further including means for selectively transferring a volume of liquid from said reservoir to said playing area.

11. A liquid-propelled scoring game as claimed in claim 10 wherein said transferring means include a pump in fluid communication with said supply of liquid, an electric motor electrically connected to said pump, a fluid conduit interconnecting said pump and said playing area and a first valve means on said fluid conduit which is operably connected to said electric motor and which senses that said volume of liquid is within said playing area.

12. A liquid-propelled scoring game as claimed in claim 10 further including means for selectively returning said volume of liquid from said playing area to said reservoir.

13. A liquid-propelled scoring game as claimed in claim 12 wherein said returning means includes a fluid tube in flow communication with said playing area and said reservoir and a second valve means on said fluid tube operable between a closed position to prevent said volume of liquid from flowing through said fluid tube and an open position whereby said volume of liquid is allowed to flow through said fluid tube into said reservoir.

14. A liquid propelled scoring game as claimed in claim 13 wherein said timing means operable for a selected period of time is further connected to said electric motor and said second valve means whereby when said timing means is energized, said electric motor is actuated and said second valve means is moved to said closed position and, after the passage of said period of time, said second valve means is moved to said open position.

15. A liquid-propelled scoring game as claimed in claim 14 wherein said means on said housing for activation of said game includes coinage receiving slots.

16. A liquid-propelled scoring game, comprising:

(a) a housing;

(b) a playing area defined within said housing and which is capable of holding a volume of liquid therein;

(c) a plurality of projectile channels within said playing area and having longitudinal axes which intersect within said playing area;

(d) a projectile dimensioned to be received within said channels;

(e) means in said playing area associated with each of said projectile channels for detecting the position of said projectile;

(f) scoring means electrically connected to said detecting means;

(g) a plurality of independently operable liquid directing means in communication with said channels whereby, when a volume of liquid is held within said playing area, the actuation of a selected one of said liquid directing means propels said projectile within an associated one of said channels toward said detecting means associated with said one channel in order to register on said scoring means while the other of said liquid directing means is operable to affect the direction of travel of said projectile away from said detecting means associated with said one channel;

(h) means for activating and deactivating said directing means;

(i) a reservoir of liquid within said housing in communication with said playing area, said reservoir capable of retaining at least said volume of liquid;

(j) means for transferring said volume of liquid from said reservoir into said playing area including a pump in fluid communication with said supply of liquid, an electric motor electrically connected to said pump, a fluid conduit interconnecting said pump and said playing area and a first valve means on said fluid conduit which is operably connected to said electric motor and which senses that said volume of liquid is within said playing area;

(k) means for evacuating said volume of liquid from said playing area into said reservoir including a fluid tube in flow communication with said playing area and said reservoir and a second valve means on said fluid tube operable between a closed position to prevent said volume of liquid from flowing through said fluid tube and an open position whereby said volume of liquid is allowed to flow through said fluid tube into said reservoir;

(l) coin receiving means on said housing; and (m) a timing means operable for a selected period of time and being electrically connected to said coin receiving means and said second valve means whereby said timing means is energized by coinage being deposited into said coin receiving means so that said motor actuates said pump to cause said volume of liquid to flow into said playing area while said second valve is in said closed position and, after passage of said selected period, to cause said second valve to move to said open position to allow said liquid to flow through said fluid tube into said reservoir, said timing means after energization also serving to actuate said activating and deactivating means to activate said directing means, and after passage of said selected period of time, serving to deactivate said directing means by deactuating said activating and deactivating means.

17. A game as claimed in claim 16 further including second means associated with said playing area and said projectile channels for detecting the position of said projectile within said playing area and to cause said activating and deactivating means to deactivate said independently operable directing means during play upon detection of said projectile within said playing area and to cause said activating and deactivating means to activate said directing means upon detection of said projectile within said channels.

* * * * *